US006363607B1

(12) United States Patent
Chen et al.

(10) Patent No.: US 6,363,607 B1
(45) Date of Patent: Apr. 2, 2002

(54) METHOD FOR MANUFACTURING A HIGH DENSITY CONNECTOR

(75) Inventors: Chao-Hsu Chen; Ming-Wu Lee; Kun-Tsan Wu, all of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/414,653

(22) Filed: Oct. 6, 1999

(30) Foreign Application Priority Data

Dec. 24, 1998 (TW) ..... 87121637 A

(51) Int. Cl.[7] ..... H01R 43/00

(52) U.S. Cl. ..... 29/883; 29/882; 29/884; 439/736

(58) Field of Search ..... 29/883, 884, 874, 29/876, 877, 878, 879, 882; 439/188, 79, 736

(56) References Cited

U.S. PATENT DOCUMENTS 4,690,479 A * 9/1987 Hollyday et al. ..... 439/97
4,992,056 A * 2/1991 Douty et al. ..... 439/83
5,057,027 A * 10/1991 Yamada et al. ..... 439/83
5,133,670 A * 7/1992 Doi et al. ..... 439/79
5,697,799 A * 12/1997 Consoli et al. ..... 439/181
6,041,498 A * 3/2000 Hillbish et al. ..... 29/833
6,116,492 A * 9/2000 Chou ..... 228/44.3
6,125,535 A * 10/2000 Chiou et al. ..... 29/833
6,132,261 A * 10/2000 Lee et al. ..... 439/376

* cited by examiner

*Primary Examiner*—Lee Young
*Assistant Examiner*—Minh Trinh
(74) *Attorney, Agent, or Firm*—Wei Te Chung

(57) ABSTRACT

A method of manufacturing a high density connector comprises five steps. The first step is to prepare essential elements of the connector, such as a dielectric cover, a metallic shell, a pair of guiding members and a plurality of contacts. Each contact is L-shaped and comprises a horizontal soldering portion. The second step is to first insert mold a pair of dielectric bases around the contacts to produce a contact subassembly. The three step is to second insert mold a dielectric housing around the contact subassembly to form a contact module. The forth step is to adjust the horizontal soldering portions of the contacts for ensuring a good coplanarity thereof. The fifth step is to assemble the contact module with the cover, the shell and the guiding members, thereby completing the connector. The method of the present invention can produce connection with high density contacts having good insert-molding qualities by double insert molding to form the contact module, resulting in the horizontal soldering sections of the contacts having good coplanarity and having good electrical communication quality.

18 Claims, 7 Drawing Sheets

METHOD FOR MANUFACTURING A HIGH DENSITY CONNECTOR

BACKGROUND OF THE INVENTION

The present invention relates to a method for manufacturing a high density connector, and particularly to a double-step insert molding method for manufacturing a high density connector.

DESCRIPTION OF PRIOR ART

As communication technology develops, information transmission between different electronic instruments have become more and more frequent, and simultaneously, the volume of the information transmitted increases and the transmitting frequency has also becomes higher. Furthermore, the trend toward miniaturization decreases the limited inner space of the computer, reducing separation distances between electronic components in the computer. Electrical connectors have had to keep pace with these developmental trends. As a result, high density connectors have, been developed.

High density connectors aim to achieve good communication performance while providing a large quantity of conductive contacts within a limited volume. This is a complex and difficult task, and stricter requirements have been placed on manufactures of such high density connectors.

Pertinent prior art is disclosed in Taiwan Patent Application Nos. 77208350, 79204276, 80213361 and 80209266. As shown in FIG. 7, to manufacture a high density connector, first, a housing 7 is made, usually by plastics injection molding. A pair of shells 8 and a plurality of contacts 6 are formed and stamped out of metal sheets respectively. The contacts 6 are arranged in high density and are commonly connected to a carrier strip 60. The contacts 6 are inserted into corresponding passages 70 defined in the housing 7 before the carrier strip 60 is severed from the contacts 6. The shells 8 are then assembled with the housing 7, thereby completing the connector.

However, the mechanical and electrical performance of the connector may be adversely affected for the following reasons. One, uneven and overthin side walls between adjacent passages lead to a decrease in stability in position of the contacts after they have been positioned within the corresponding passages, as the engaging force between the contacts and the housing is not sufficient to resist mating/withdrawal force of the connector and a complementary connector. Second, both the contacts and the side walls of the passages of the housing may suffer damage due to the mounting of the contacts into the corresponding passages, thereby adversely affecting the electrical communication quality of the connector. Third, the more and more popular surface mounting technology (SMT) needs a coplanarity of soldering portion of contacts in a connector. However, the mechanical difficulties of inserting high density contacts into a housing of a connector increase the difficulty of achieving the coplanarity of the high density contacts, as the soldering portions are likely to be deflected.

Therefore, an improved manufacturing method for high density connectors is desired.

BRIEF SUMMARY OF THE INVENTION

A main object of the present invention is to provide a two-step insert molding method for manufacturing high density connectors which achieves connectors having good communication qualities.

Another object of the present invention is to provide a method for manufacturing high density connectors which has a simplified assembling process yielding a higher production rate.

A method for manufacturing a high density connector in accordance with the present invention comprises five steps. The first step is to prepare essential elements of the connector, such as a dielectric cover, a metallic shell, a pair of guiding members and a plurality of L-shaped contacts, each having a horizontal soldering portion connected to a carrier strip. The second step is to insert mold a pair of dielectric bases around the contacts to get a contact subassembly. The third step is to double insert mold a dielectric housing around the contact subassembly, forming a contact module. The fourth step is to adjust the horizontal soldering portions of the contacts, ensuring a good coplanarity thereof. The fifth step is to assemble the contact module with the cover, the shell and the guiding members, thereby completing the connector. The method of the present invention produces high density contacts having aligned soldering portions with good coplanarity by two-step insert molding to form the contact module. This promotes good electrical communication qualities in the contacts.

Other objects, advantages and novel features of the invention will become more apparent from the following detailed description when taken in conjunction with the accompanying drawings.

DETAILED DESCRIPTION OF THE INVENTION

Figure 1:
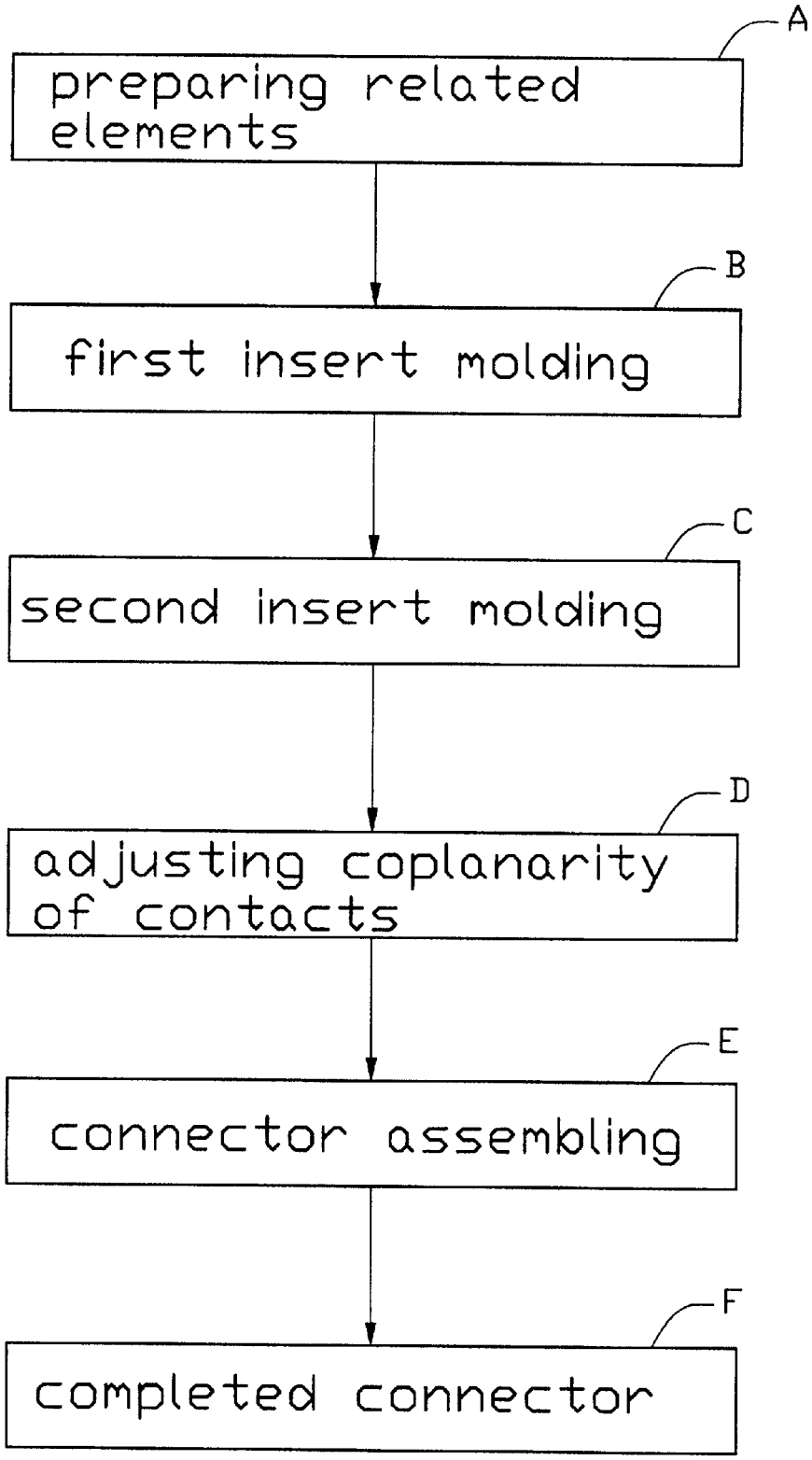
FIG. 1 is a procedural chart showing steps of the present invention.
Figure 2:
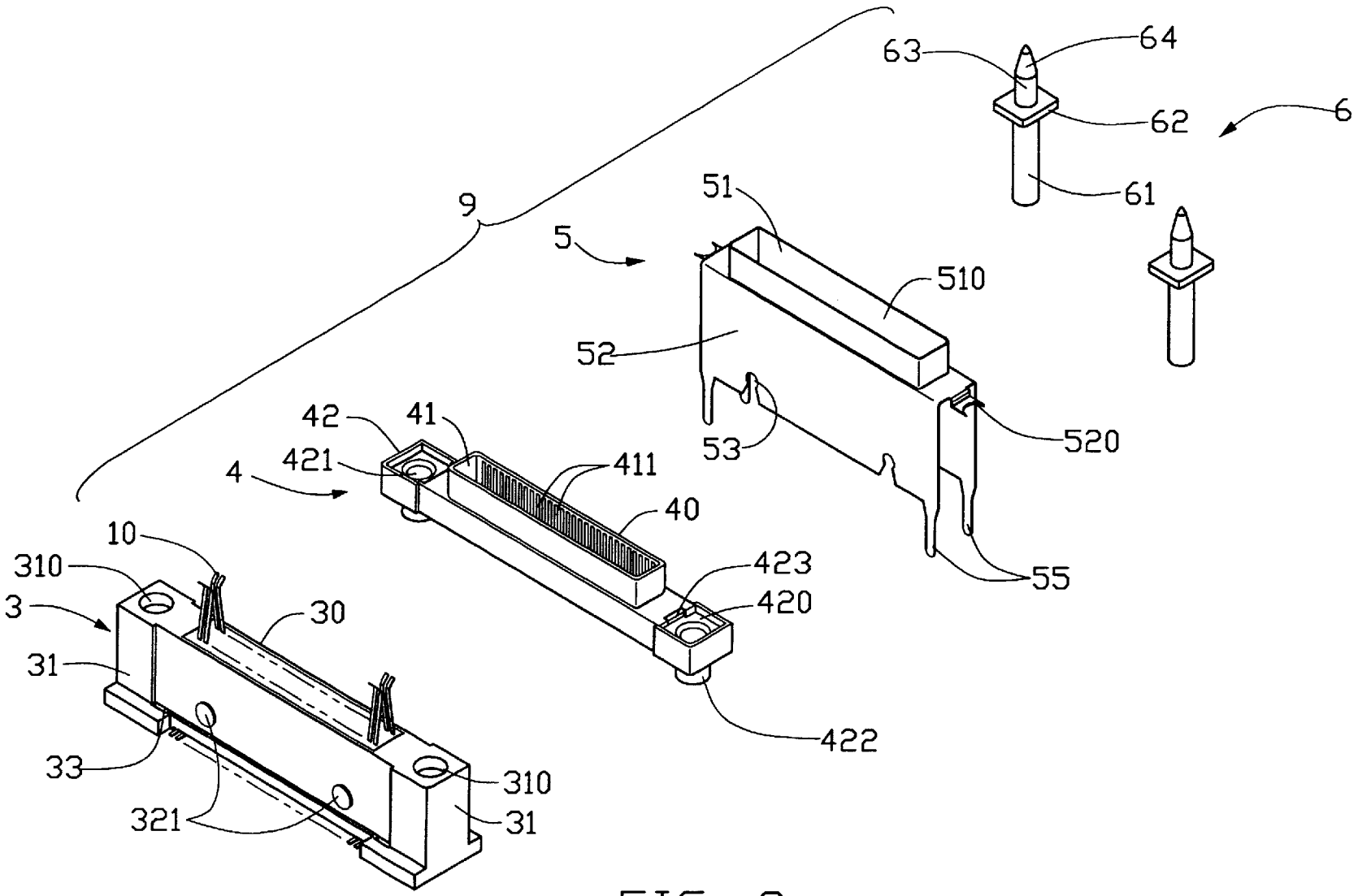
FIG. 2 is an exploded view of a connector made in accordance with the present invention.

Referring to FIGS. 1 and 2, the method for manufacturing a high density connector in accordance with the present invention comprises five steps. That is, step A, preparing essential elements of the high density connector 9 (as shown in FIG. 2); step B, performing a first insert molding to form a pair of dielectric bases 21, 22 (see FIG. 4) around a plurality of contacts 1 (see FIG. 3) to get a contact subassembly 2; step C, performing a second insert molding to form a dielectric housing 30 enclosing the bases 21, 22 thereby forming a contact module 3 (FIG. 6); step D, adjusting soldering sections 12 of the contacts 1 for coplanarity; step E, assemble the elements into a completed high density connector 9. The present invention will be described in detail, step-by-step.

Step A: Preparing Related Elements

Figure 3:
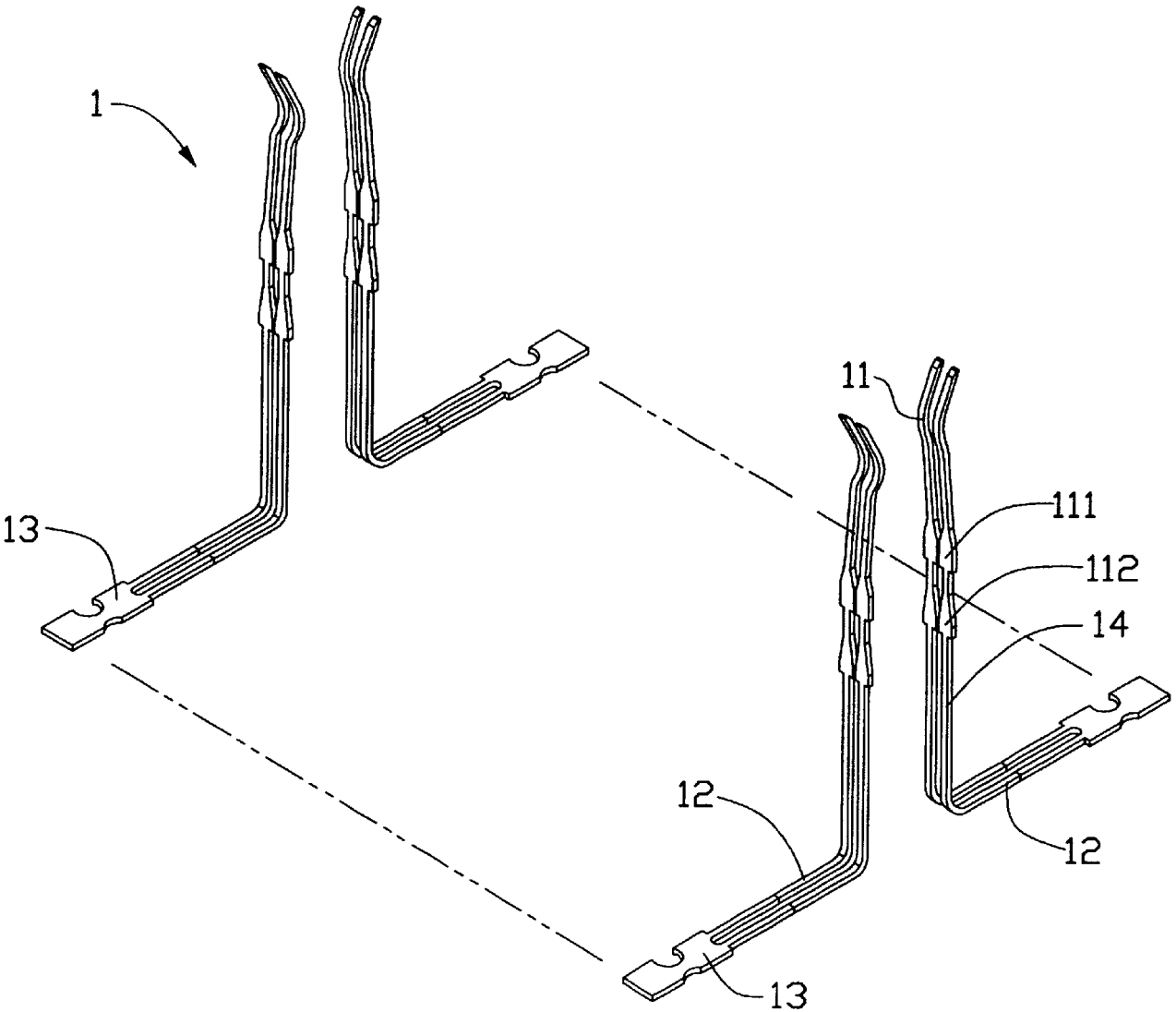
FIG. 3 is a perspective view of two rows of semi-finished contacts made in accordance with the present invention.

Referring to FIGS. 2, and 3, the essential elements of a high density connector 9 in accordance with the present invention include the contacts 1, a dielectric cover 4, a metallic shell 5 and a pair of guiding members 6.

The contacts 1 are first formed and stamped out of a sheet of metal, and are connected to a carrier strip 13. Each contact 1 is L-shaped and comprises a curved contacting section 11 at one end, a pair of upper and lower latching sections 111, 112 adjacent to the contacting section 11. The soldering section 12 is perpendicular to the contacting section 11 and the latching sections 111, 112. The contacts 1 connect with the carrier strip 13 via the soldering sections 12.

The cover 4 is fabricated, usually by insert molding to form a middle protruding portion 40 outwardly extending from a upper surface of the cover 4 and a pair of positioning portions 42 on opposite sides of the middle protruding portion 40. The protruding portion 40 defines a groove 41 therethrough and a plurality of contact receiving channels 411 in opposite side walls of the groove 41 for receiving the contacting sections 11 of the corresponding contacts 1. Each positioning portion 42 has a cavity 420 recessed in the upper surface of the cover 4, a notch 423 defined near the protruding portion 40 and in communication with the cavity 420, a leg 422 downwardly extending from a bottom surface of the cover 4, and an aperture 421 defined in the cavity 420 and partially extending into the leg 422.

The shell 5 is formed and stamped, also from a metal sheet, and comprises an outwardly extending mating portion 51, and a pair of side walls 52 extending from opposite sides of the mating portion 51 in an opposite direction, and a pair of tabs 520 laterally extending from opposite ends of the mating portion 5 between the side walls 52.

The post-like guiding members 6 are made preferably of metal material and each has a retention plate 62 formed near an end thereof.

Step B: First Insert Molding

Figure 4:
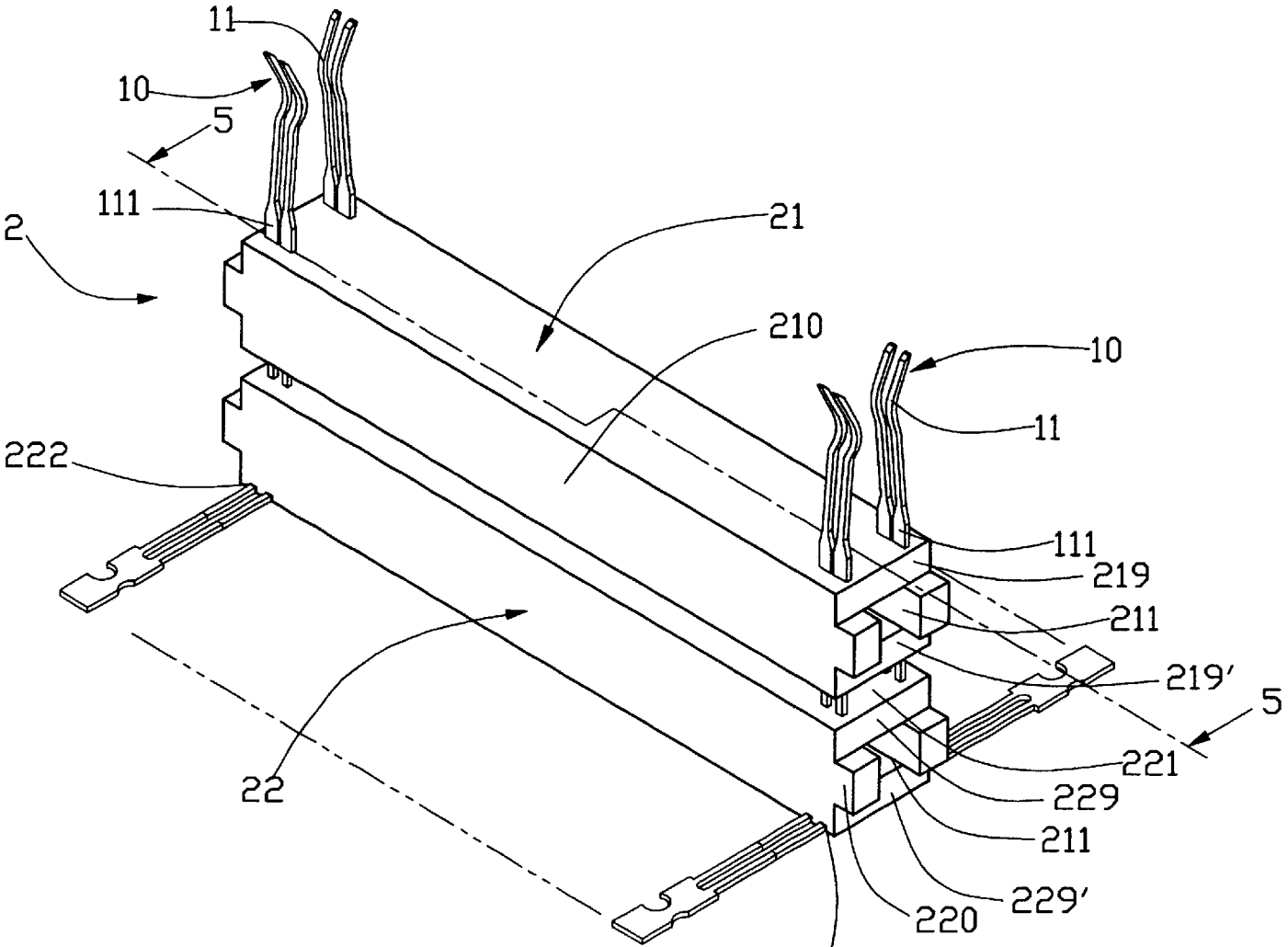
FIG. 4 is a perspective view of a contact subassembly made in accordance with the present invention.
Figure 5:
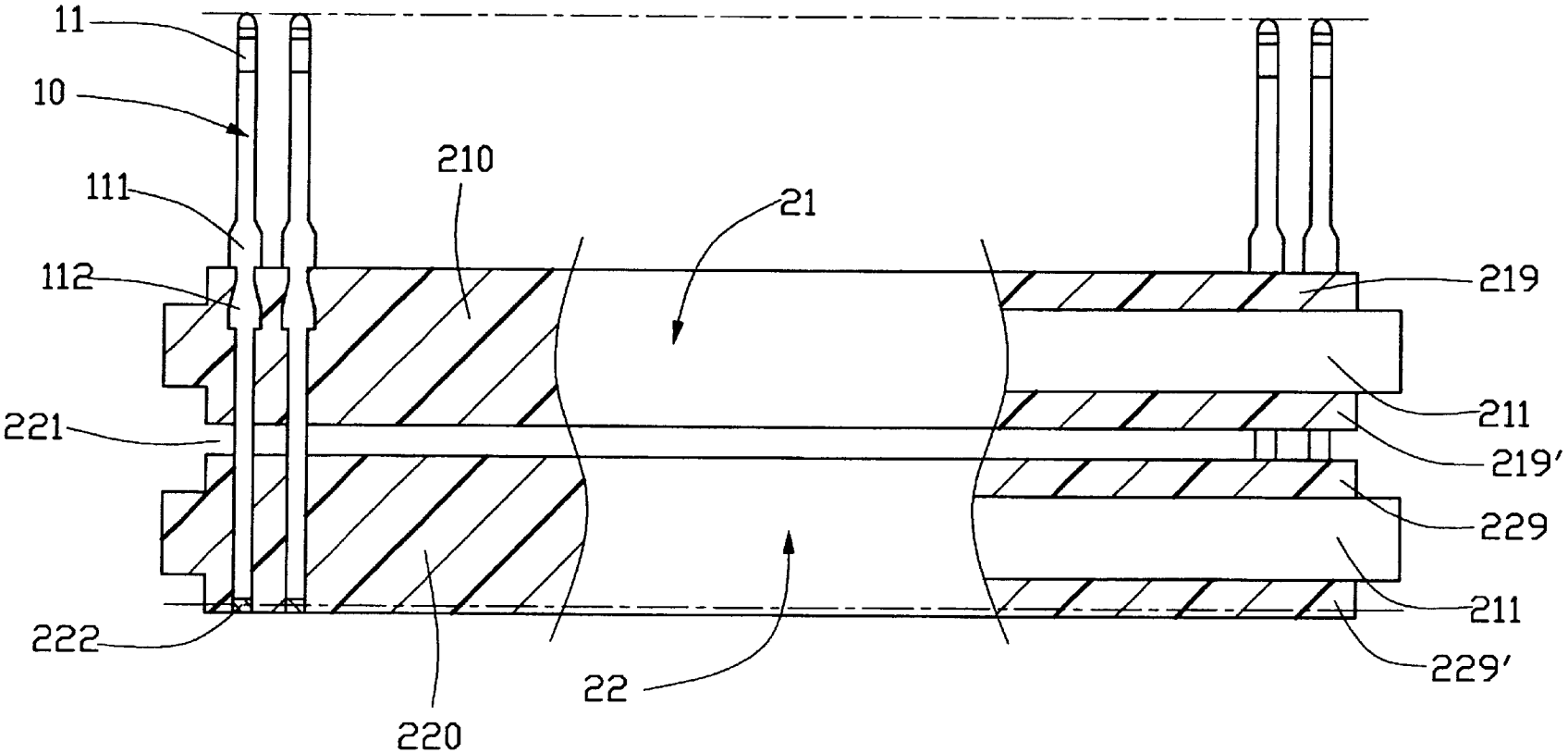
FIG. 5 is a cross-sectional view taken along 5—5 line of FIG.4.

The contacts 1 along with the carrier strip 13 are positioned within a mold (not shown). The pair of dielectric bases 21, 22 is then insert molded to enclose the lower latching sections 112 of the contacts 1 thereby forming a contact subassembly 2 as shown in FIGS. 4 and 5. Each base 21, 22 is a rectangular, hollow beam with two sidewalls 210, 220 through which the latching sections 112 extend. The upper base 21 has an upper board 219 and a lower board 219' connected to opposite sides of the sidewalls thereof 210. Similarly, the lower base 22 has an upper board 229 and a lower board 229' bridging upper and lower sides of the sidewalls 220. A passageway 211 extends longitudinally through each base between corresponding sidewalls and boards.

The lower parts of the upper latching sections 111 of the contacts 1 are located to abut against a top surface of the upper base 21 while the lower latching sections 112 are engaged within the upper board 210 of the upper base 21 thereby preventing the upper base 21 from vertically moving along the contacts 11. The lower base 22 defines a plurality of engaging slots 222 in a bottom surface for engaging parts of the soldering sections 12 of the contacts 1, thus, the contacts 1 are integrally secured with the upper and lower bases 21, 22.

A suitable distancing space 221 is defined between the upper and lower bases 21, 22 and the passageway 211 is defined through each of the upper and lower bases 21, 22 for facilitating the flow of molten insulating material having the second insert molding step thereby ensuring a good insert-molded quality product.

Step C: Second Insert Molding

The contact subassembly 2 is positioned in another mold (not shown), and a dielectric housing 30 is insert molded to surround the contact subassembly 2 thereby forming the contact module 3 as shown in FIG. 1. The contacting sections 11 of the contacts 1 upwardly extend from a top surface of the housing 30 while the horizontal soldering sections 12 laterally extend from a bottom surface of the housing 30 for being surface mounted to a circuit board (not shown). The upper and lower bases 21, 22 are securely received within the housing 30.

The housing 30 comprises a pair of platforms 31 on opposite ends corresponding to the positioning portions 42 of the cover 4 and a positioning hole 310 defined in each platform 31 for engaging with the corresponding leg 422 of the cover 4. A pair of engaging buttons 321 is formed on each of two opposite side walls of the housing 30 for engaging with corresponding engaging apertures 53 defined in a bottom edge of the corresponding side wall 52 of the shell 5. A pair of slits 33 is defined in opposite sides of each platform 31 adjacent to the soldering sections 12 of the contacts 1 for engaging with corresponding leg-like engaging portions 55, which downwardly extend from bottom edges of the side walls 52 of the shell 5.

Step D: Adjusting Coplanarity of Contacts

After the second insert molding step, the contact module 3 is appropriately positioned. Special tooling (not shown) is then operated to adjust the horizontal soldering sections 12 of the contacts 1 for achieving a good coplanarity thereof after severing the carrier strip 13 from the contacts 1.

Since the upper and lower bases 21, 22 is insert molded to securely surround the vertical parts 14 of the contacts 1 except the contacting sections 11 and the upper latching sections 111 before insert molding the housing 30 to enclose the upper and lower bases 21, 22, the vertical parts 14 thus avoid adverse effects, such as deflection or deformation which could results in decreases of mechanical and electrical performances of the contacts 1, when the horizontal soldering sections 12 are undergoing adjustments thereon.

That the vertical parts 14 of the contacts 1 are relatively long normally causes difficulty during a single insert molding since, if the insert molding is done improperly, the vertical parts 14 is apt to be deflected or deformed during cooling of the insulative material, which is used to form the housing 30. This in turn can reduce the life-span of the contacts 1.

In the present invention, using a double insert molding process, by contrast, yields a better preparation for coplanarity adjustments. By first insert molding the pair of upper and lower bases 21, 22 around the vertical parts 14 of the contacts 1 and then second insert molding the housing 30 surrounding the bases 21, 22, deflection and deformation of the vertical parts 14(and thus, the contacting sections 11) of the contacts 1 is minimized. To achieve such good results, the distancing space 221 between the upper and lower bases 21, 22 as well as the passageways 211 play an important role. In the second insert molding step, the distancing space 221 and the passageways 211 allow unrestricted flow of the molten insulating material therethrough, whereby the material for forming the housing 30 enclosing the bases 21, 22 and the vertical parts 14 of the contacts 1 can fill the cavity of the mold for the second insert molding, thus, the housing 30 can have a homogenous quality. Since the forces acting internal to the molten insulating material during cooling are dispersed by the two-step insert molding as described above, the vertical parts 14 of the contacts 1 avoid unfavorable deflection or deformation accordingly.

This, in turn, makes it easier to adjust the horizontal soldering sections 12 of the contacts 1 to achieve good coplanarity and reliable electrical performance.

Step E: Assembling

Figure 6:
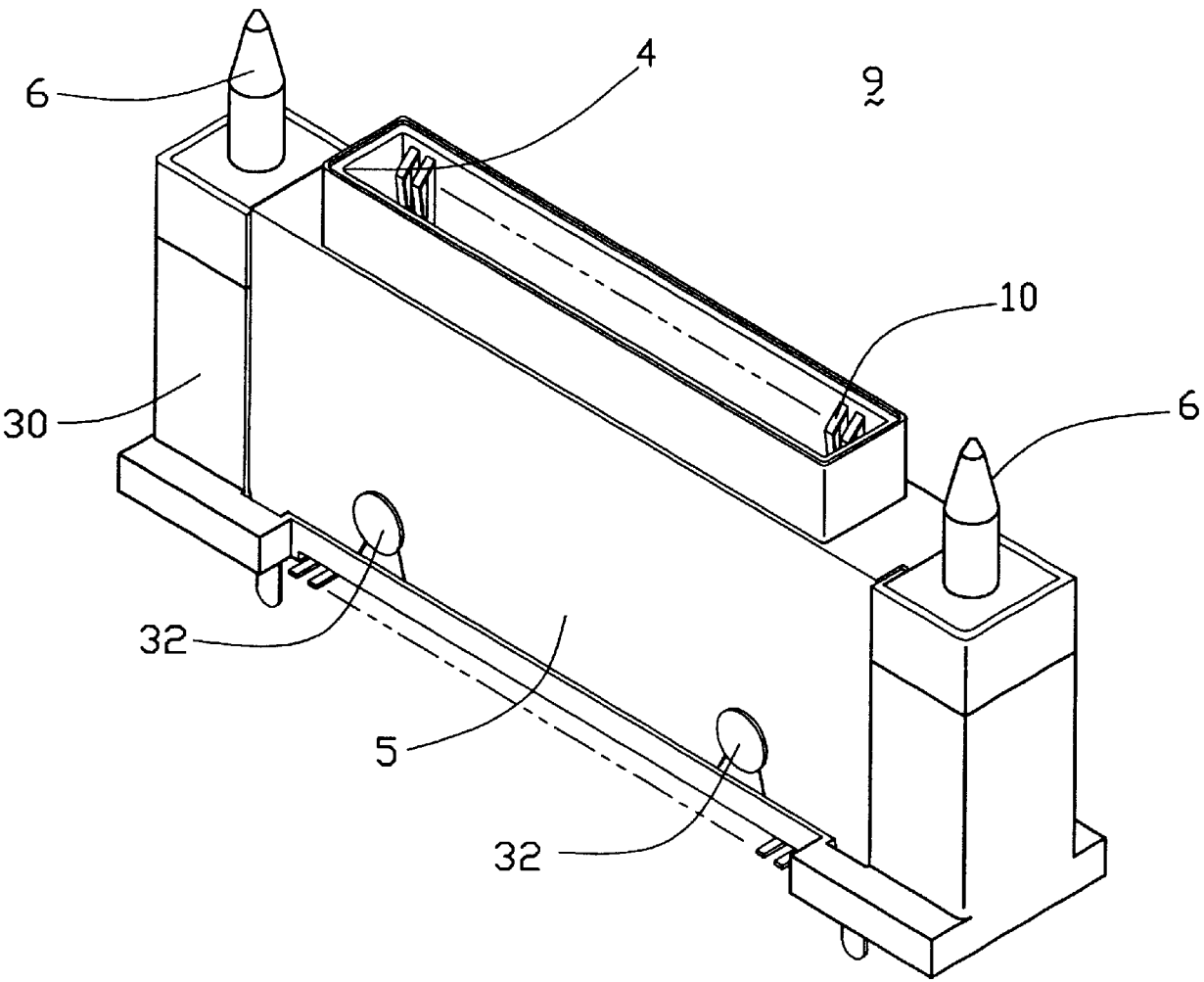
FIG. 6 is an assembled view of FIG. 2.
Figure 7:
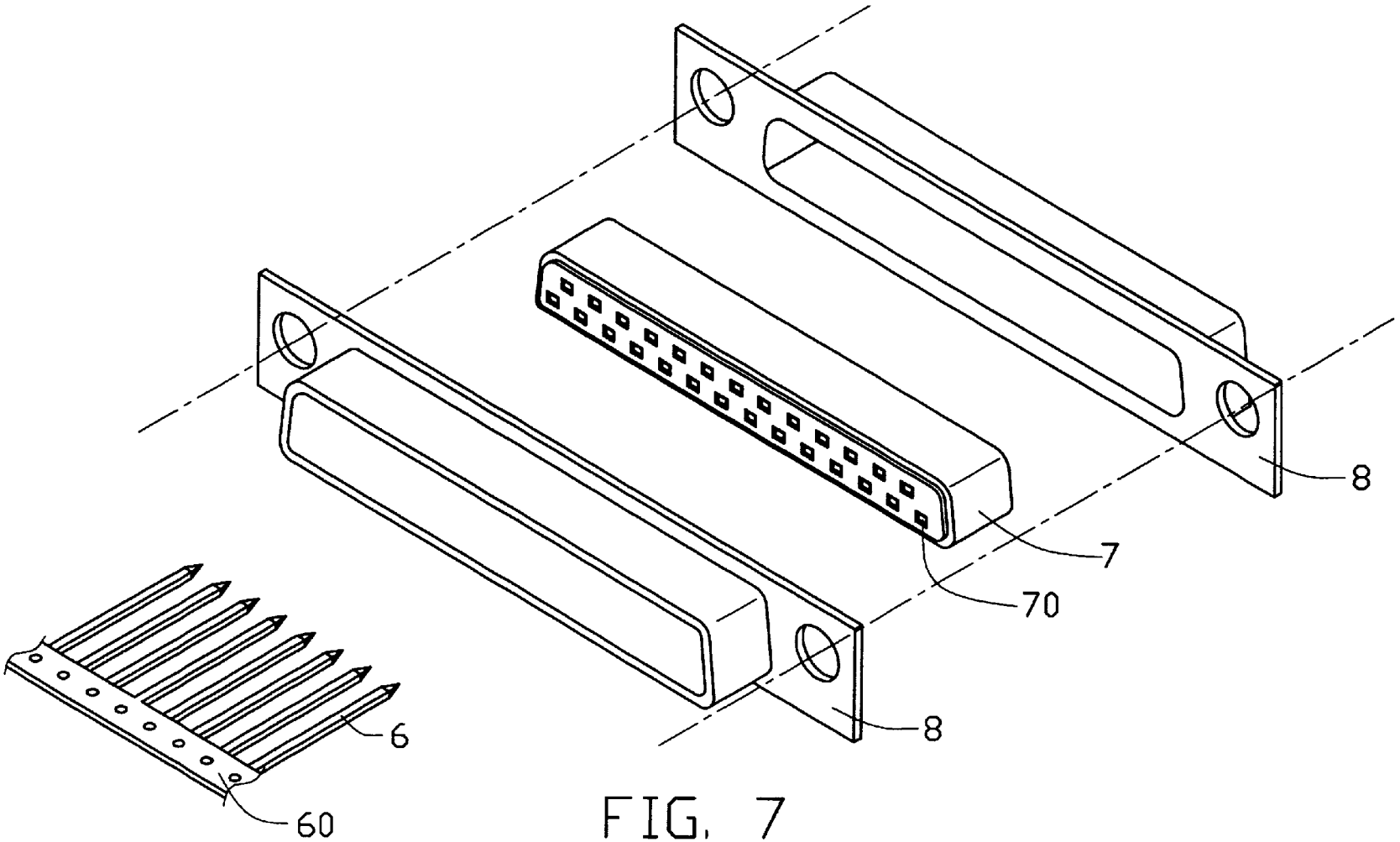
FIG. 7 (PRIOR ART)
FIG. 7 is an exploded view of a prior art connector.

Referring to FIGS. 2 and 6, the cover 4 is first made to engage with the contact module 3. The legs 422 of the cover 4 are interferentially received within the corresponding positioning holes 310 of the housing 30, while the contacting sections 11 of the contacts 1 are positioned within the corresponding contact receiving channels 411 of the protruding portion 40. The shell 5 is then fixed to the cover 4 and the contact module 3. The protruding portion 40 of the cover 4 is received within an opening 510 defined in the mating portion 51 of the shell 5. The leg-like engaging portions 55 of the shell 5 engage with the corresponding slits 33 of the housing 30, while the tabs 520 engage with the corresponding notches 423 of the cover 4 and locate within the corresponding cavity 420. The engaging buttons 321 engage with the corresponding engaging apertures 53 of the shell 5.

The guiding members 6 are finally mounted in the contact module 3, the cover 4 and the shell 5. A lower end 61 of each guiding member 6 engages within the corresponding aperture 421 of the cover 4, while the retention plate 62 is located within the cavity 420 of the cover 4 and electrically contacts the corresponding tabs 520 of the shell 5. An upper end 63 of each guiding member 6 is conical and outwardly extends for engaging with a metal shell of a mating connector (not shown) thereby forming a grounding connection therewith.

Thus, the completed connector F (9) is achieved after assembling the contact module 3, the cover 4, the shell 5 and the guiding members 6 together.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method of manufacturing a high density connector, comprising:

preparing a plurality of contacts, each contact being formed to have a vertical part and a horizontal soldering section transversely connected to the vertical part;

first insert molding a pair of upper and lower dielectric bases partially surrounding the vertical parts of the contacts and distanced from each other thereby forming a contact subassembly, each of the bases having a passageway longitudinally extending therethrough;

second insert molding a dielectric housing for enclosing the contact subassembly thereby forming a contact module;

adjusting the coplanarity of the horizontal soldering sections of the contacts; and assembling the contact module with a dielectric cover.

2. The method of manufacturing a high density connector as claimed in claim 1, wherein the first insert molding step comprises forming a distancing space between the upper and lower bases, flowing molten insulating material, and adjusting coplanarity of the horizontal soldering sections of the contacts.

3. The method of manufacturing a high density connector as claimed in claim 1, wherein the first insert molding step comprises forming a passageway transversely extending through each of the upper and lower dieletric base.

4. The method of manufacturing a high density connector as claimed in claim 1, wherein the preparing step comprises forming the vertical part of each contact having a curved contacting section at one end thereof, a pair of upper and lower latching sections adjacent to the contacting section.

5. The method of manufacturing a high density connector as claimed in claim 4, wherein the preparing step comprises forming the contacts connected with a carrier strip via the horizontal soldering sections thereof.

6. The method of manufacturing a high density connector as claimed in claim 5, wherein the adjusting step comprises severing the carrier strip away from the contacts.

7. The method of manufacturing a high density connector as claimed in claim 2, wherein the first insert molding step comprises defining a plurality of engaging slots in a bottom surface of the lower base receiving parts of the soldering sections of the contacts thereby ensuring coplanarity of the parts of the soldering sections.

8. The method of manufacturing a high density connector as claimed in claim 7, wherein the preparing step comprises fabricating a metallic shell for enclosing the contact module and the cover.

9. The method of manufacturing a high density connector as claimed in claim 8, wherein the second insert molding step comprises forming a pair of platforms on opposite ends of the metallic shell and a positioning hole defined in each platform of the housing.

10. The method of manufacturing a high density connector as claimed in claim 9, wherein the second insert molding step comprises forming a pair of slits in opposite sides of each platform adjacent to the soldering sections of the contacts for engaging with the shell.

11. The method of manufacturing a high density connector as claimed in claim 10, wherein the preparing step comprises forming leg-like engaging portions downwardly extending from bottom edges of side walls of the shell.

12. The method of manufacturing a high density connector as claimed in claim 11, wherein the second insert molding step comprises forming a pair of engaging buttons on each of opposite side walls of the housing for engaging with the shell.

13. The method of manufacturing a high density connector as claimed in claim 12, wherein the preparing step comprises defining engaging apertures in bottom edges of side wall of the shell for engaging with corresponding engaging buttons of the housing.

14. The method of manufacturing a high density connector as claimed in claim 13, wherein the preparing step comprises forming a middle protruding portion outwardly extending from an upper surface of the cover for accommodating the curved contacting sections of the contacts therein and a pair of positioning portions on opposite sides of the middle protruding portion for engaging with the housing and the shell.

15. The method of manufacturing a high density connector as claimed in claim 14, wherein the preparing step comprises providing a pair of post-like guiding members, each guiding member forming one end for engaging within corresponding apertures of the cover and an opposite conical end for engaging with a mating connector, each guiding member including a horizontal plate for engaging within corresponding cavities of the cover.

16. The method of manufacturing a high density connector as claimed in claim 8, wherein the preparing step comprises forming a cavity recessed in the upper surface of the cover, a notch defined near the protruding portion and in communication with the cavity, a leg downwardly extending from a bottom surface of the cover for engaging with the housing, and an aperture defined in the cavity and partially extending into the leg.

17. The method of manufacturing a high density connector as claimed in claim 1, wherein the first insert molding step including forming a pair of sidewalls at lateral sides of the upper base and embedding a section of the vertical parts of the contacts in the sidewalls, the passageway of the upper base extending between the sidewalls.

18. The method of manufacturing a high density connector as claimed in claim 17, wherein the preparing step including forming latching sections at lateral sides of the vertical part of each contact, and wherein the first insert molding step including forming an upper board of the upper base connecting the sidewalls of the upper base and embedding the latching sections in the upper board.

* * * * *